US005544456A

United States Patent [19]

Dries

[11] Patent Number: 5,544,456

[45] Date of Patent: Aug. 13, 1996

[54] DOOR AND JAMBS AND JAMB-LININGS PERTAINING THERETO

[75] Inventor: Rudi Dries, Zoersel, Belgium

[73] Assignee: Liexco S.A., Grand Duche du Luxembourg

[21] Appl. No.: 295,089

[22] Filed: Aug. 24, 1994

[30] Foreign Application Priority Data

Aug. 24, 1993 [BE] Belgium ..... 09300868

[51] Int. Cl.[6] ..... E06B 1/04

[52] U.S. Cl. ..... 52/204.1; 49/383; 52/213

[58] Field of Search ..... 52/204.1, 213, 52/215; 49/383, 483.1

[56] References Cited

U.S. PATENT DOCUMENTS

| | | |
|---|---|---|
| 3,141,204 | 7/1964 | Wheeler . |
| 3,827,183 | 8/1974 | Zimmerman et al. . |

FOREIGN PATENT DOCUMENTS

| | | |
|---|---|---|
| 2169003 | 9/1973 | France . |
| 87127 | 7/1895 | Germany . |
| 1684083 | 10/1969 | Germany . |
| 2725159 | 12/1978 | Germany . |
| 3705800 | 11/1988 | Germany . |
| 36870 | 4/1959 | Luxembourg . |
| 343110 | 1/1960 | Switzerland . |

*Primary Examiner*—Carl D. Friedman
*Assistant Examiner*—Creighton Smith
*Attorney, Agent, or Firm*—Birch, Stewart, Kolasch & Birch, LLP

[57] ABSTRACT

A door has a door sheet and jambs and jamb-linings which are to be fitted in a wall opening. The jamb has at least on the side of the pivot axis (X) a continuous bowl-shaped cavity (2) directed towards the door sheet (4). The edge of the door sheet (4) fits into the bowl-shaped cavity (2). This cavity (2) has a radius which is substantially equal to the distance between the center line of the pivot axis (X) of the door sheet and the edge of the door sheet (4).

20 Claims, 16 Drawing Sheets

DOOR AND JAMBS AND JAMB-LININGS PERTAINING THERETO

FIELD OF THE INVENTION

This invention relates to a door consisting of a door sheet and jambs and jamb-linings pertaining thereto, and which are to be fitted in a wall opening, the pivot axis of the door sheet being situated on a distance from the jamb which is fitted vertically against one side of the wall opening, and the jamb has a continuous bowl-shaped cavity, directed towards the door sheet, and wherein the concerned edge of the door sheet fits, which bowl-shaped cavity has a radius substantially equal to the distance between the center line of the pivot axis of the door sheet and said edge of the door sheet.

DESCRIPTION OF THE BACKGROUND ART

It has already been proposed to hinge a window or door sheet on one of its vertical edges with its extremity on an arc-shaped cavity of a jamb for a window or a door. Examples of such solutions can be found in the following documents: DE 87 127; DE 27 25 159 and LU 36 870.

SUMMARY OF THE INVENTION

A particular object of the invention is to prescribe a door having a jamb permitting the door to be pivotally mounted on the left or right hand side in the jamb and, if need may be, to make from the door either a two-way door or a one way door.

In order to accomplish this according to the invention, said bowl-shaped cavity has a continuous open chamber with a cross-section enabling it to fit different abutments and bumpers.

Another very remarkable object of the invention is to provide means whereby the jamb-linings pertaining to the door and to the jambs are easy to remove and to be put back; the combination of jamb and jamb-linings having, in this respect, to be adaptable to various dimensions to achieve a door structure of large flexibility. It must be possible to compensate for the tolerances in wall finishing observed when mounting the door jambs.

Still according to the invention and in view of providing a technically reliable solution for the problem set forth hereinabove concerning the flexibility, said jambs comprise two wings extending laterally with respect to said continuous bowl-shaped cavity for receiving jamb-linings, and said jamb-linings comprise a resilient wing which may be clamped between the wings of the jamb.

BRIEF DESCRIPTION OF THE DRAWINGS

Other details and advantages of the invention will become apparent from the following description of a door consisting of a door sheet and jambs and jamb linings pertaining thereto according to the invention. This description is only given by way of example and does not limit the invention. The reference numerals relate to the annexed figures.

For clarity's sake, the hatching in certain components has not be indicated in different figures.

DETAILED DESCRIPTION OF THE PREFERRED EMBODIMENTS

The door shown in these figures is a pivoting door, the door sheet, or in some cases both door sheets, of which have to be able to be pivoted in one or in both directions over 90°.

An essential object of these doors is that it does not present the dangerous nut-cracker effect. This results from the combination of the following two characteristics. In such a door, the pivot axis X (indicated in the different figures by a small cross) is situated on a distance of the jamb 1 concerned and this jamb shows a bowl-shaped cavity 2 wherein the bumper 3 or 9 of the door sheet 4 fits and may pivot. To this end, said bowl-shaped cavity 2 has a curvature radius which is substantially equal to the distance between the center line of the pivot axis X and the inner wall of this cavity.

Figure 27:
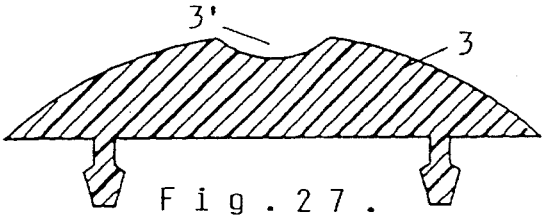
FIG. 27 is a cross-section through a bumper to be used in combination with a tubular abutment.

This means therefore that the bumper 3 or 9 of the door sheet 4 pivots purely in this bowl-shaped cavity 2. The danger of objects or fingers getting between door sheet and jamb is therefore out of the question. A bumper 3 has, according to the here most often represented embodiment, in the middle of its curved edge a rounded cavity 3' (see especially FIG. 27), the role of which will be explained hereinafter. The bumpers which are provided on the side turned away from the hinged side and on the upper side carry the reference 5 (see FIG. 28).

Figure 31:
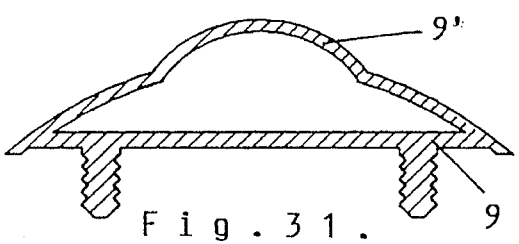
FIG. 31 is a cross-section through a bumper which is used as a variant embodiment for fixing the cooperating unit, formed by FIGS. 26 and 27, on the hinge side onto a door sheet.
Figure 32:
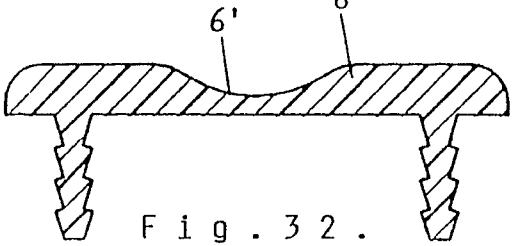
FIG. 32 is a cross-section through a bumper according to a variant embodiment to be used in combination with a spherical abutment.
Figure 30:
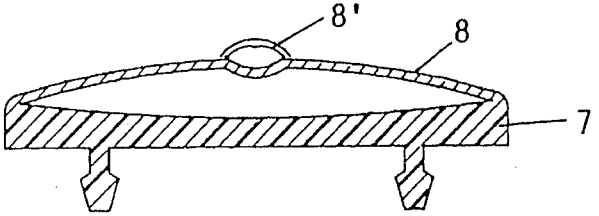
FIG. 30 is a cross-section through an abutment according to a variant embodiment to be used for a door having two door sheets.

Such a bumper 5 may show in the middle a rounded cavity 5'. FIG. 32 shows a bumper 6 having wider rounded cavities 6'. FIG. 30 shows an abutment 7 having a convex side 8 with continuous bulges 8'. Finally, FIG. 31 shows a particular bumper 9 having a spherical bulge 9'. The bumper 9 with its spherical profile 9' fulfils a well determined function as a variant embodiment of bumper 3. This bumper is further described with respect to FIG. 5.

Figure 18:
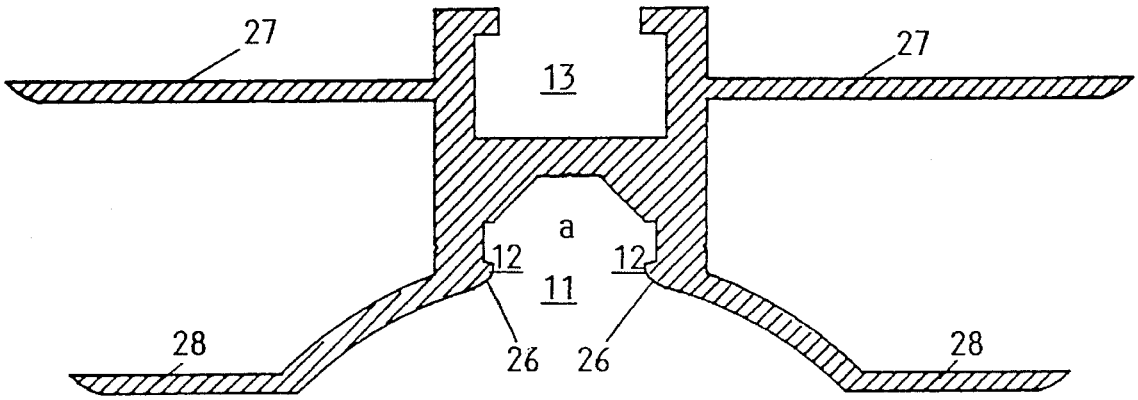
FIG. 18 is a cross-section through a profile which forms the jamb of the door according to the invention.

The jambs 1 which form both vertically as well as horizontally, i.e. above in the door opening, the door casing, consist of profiles 10 showing the already earlier mentioned bowl-shaped cavity 2 (FIG. 18).

In the middle of this cavity 2, there extends a continuous open chamber 11. This chamber includes two lateral grooves 12. The continuous open chamber 11 with its grooves 12 serves for receiving abutments with various sections. They are described hereinafter in detail. The various pivot shaft components are also fixed in the continuous open chamber 11.

In the profile 10, there is still a further continuous open chamber 13 intended for receiving corner connection pieces.

Figure 1:
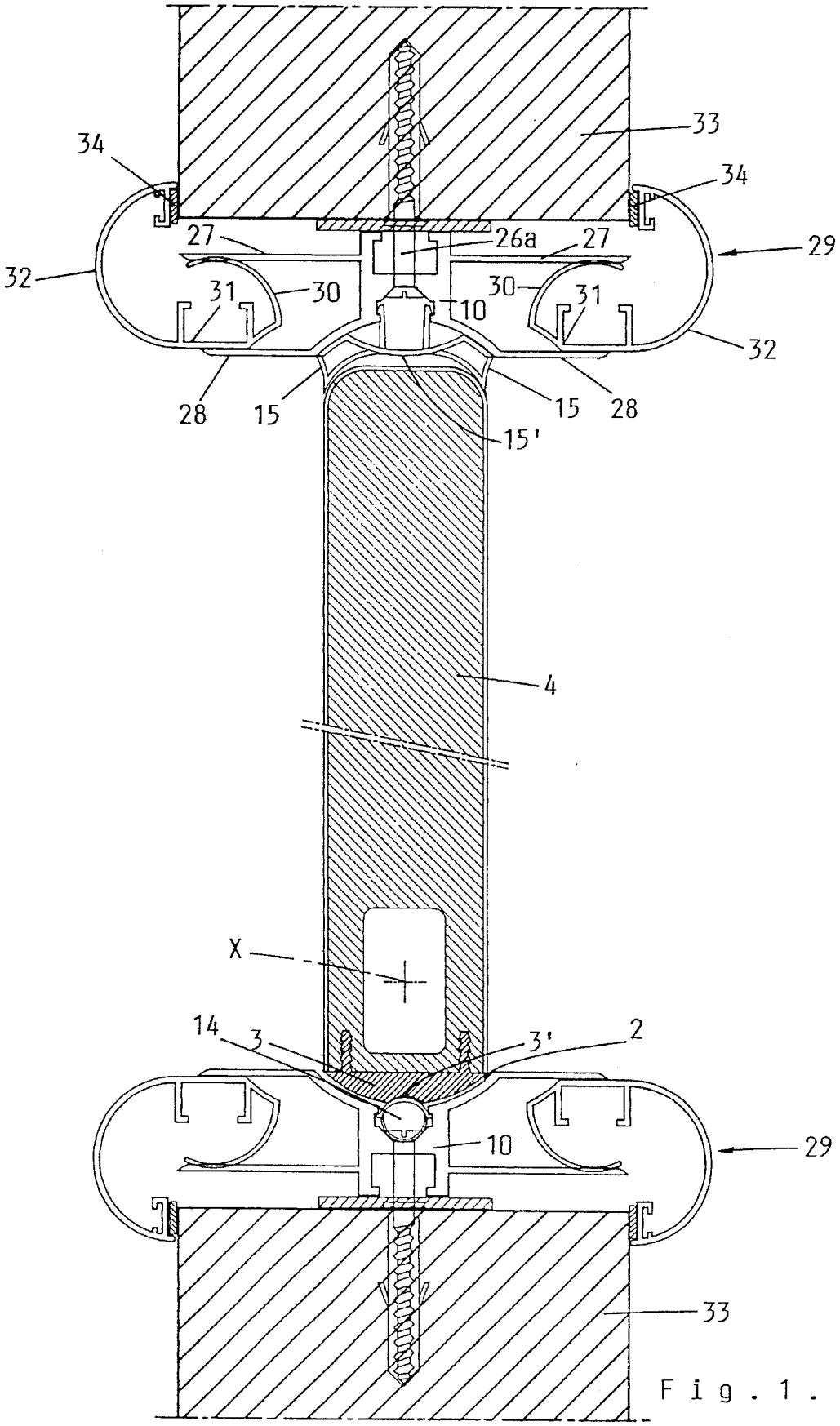
FIG. 1 is a cross-section through a door according to the invention and this according to a possible embodiment.
Figure 2:
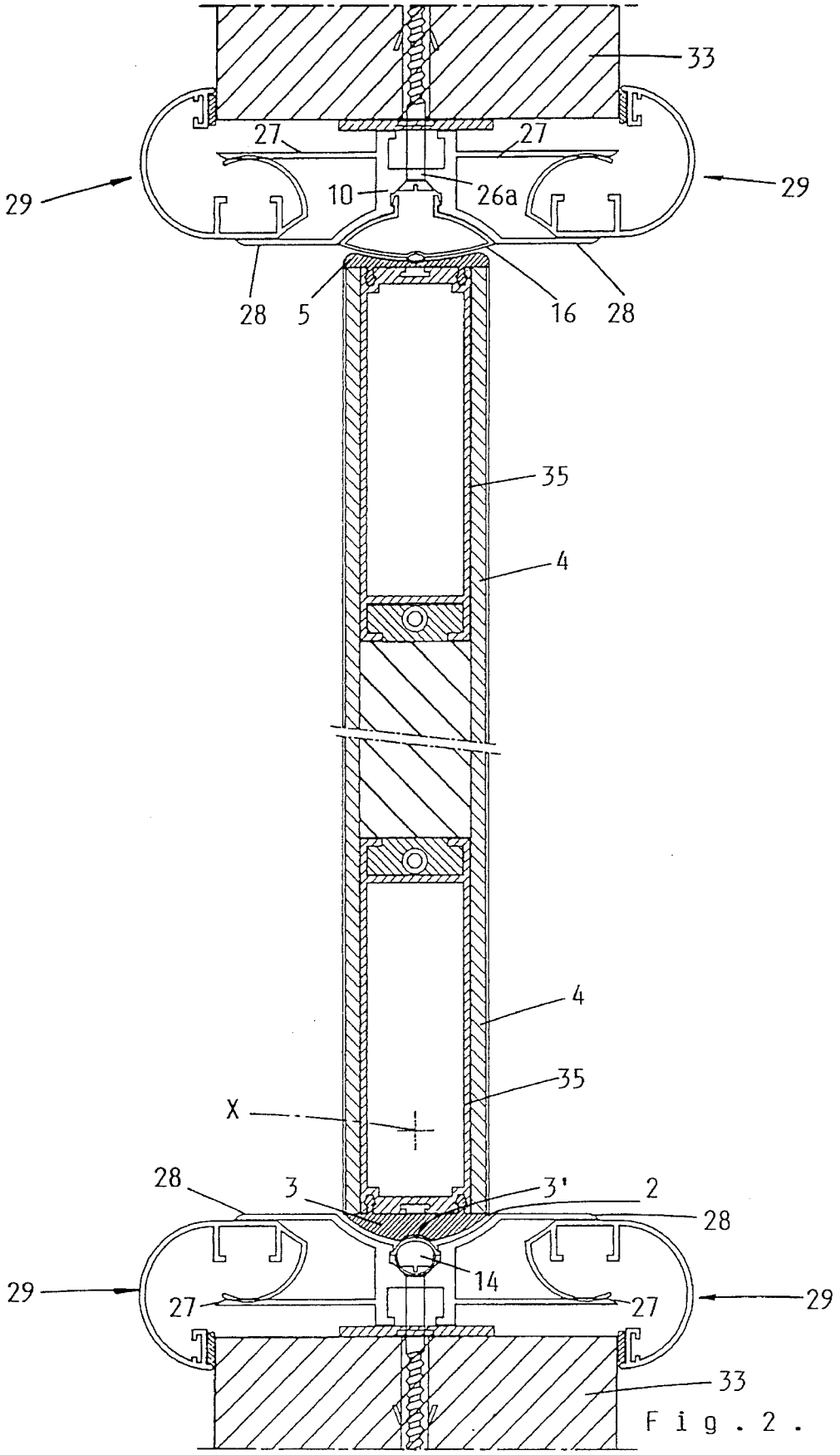
FIG. 2 is a cross-section through a two-way door having a wedge-shaped abutment.
Figure 3:
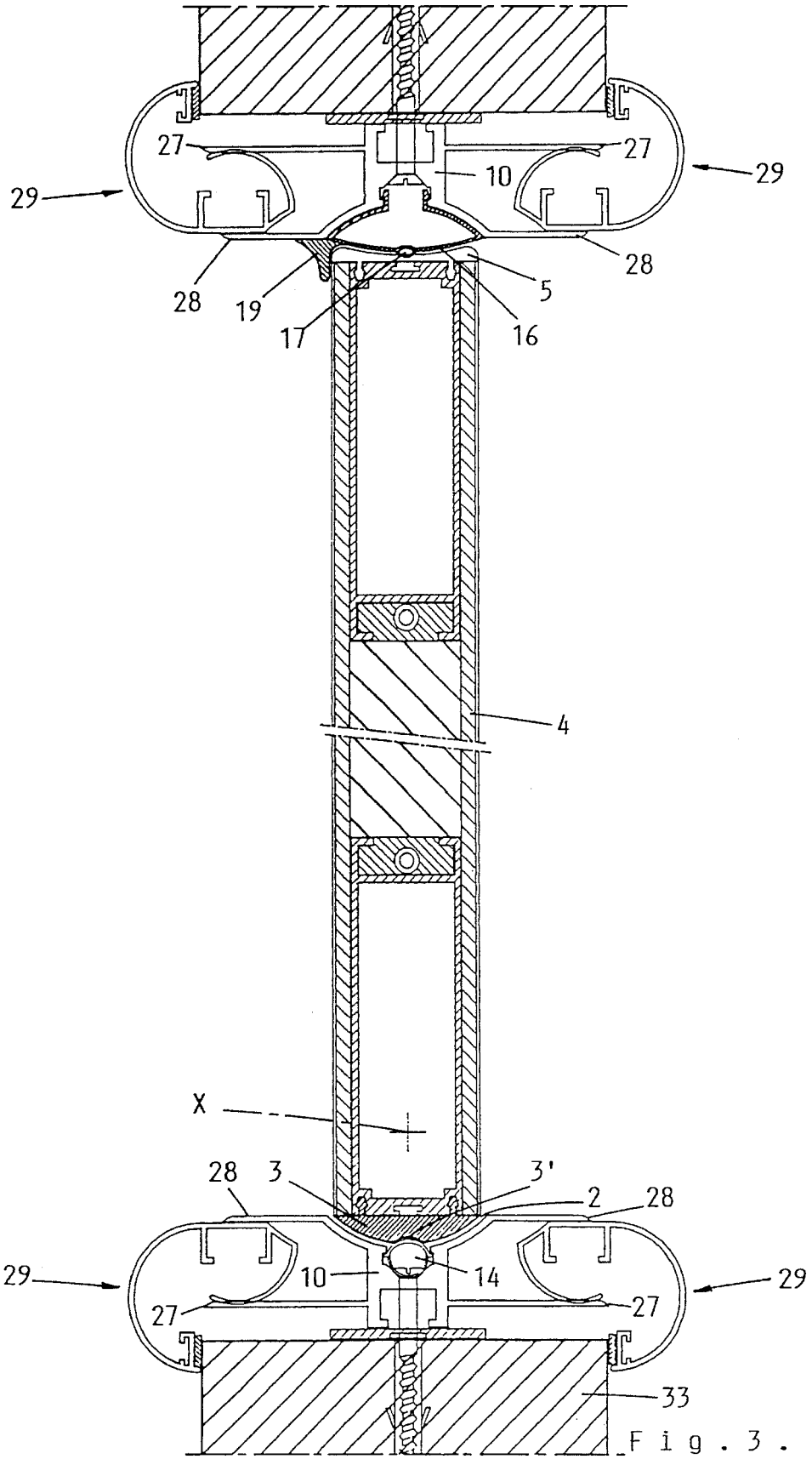
FIG. 3 is a cross-section through a one-way door having a wedge-shaped abutment.

Referring to FIGS. 1, 2, 3, 7, 8, 9 and 26, it will be seen that use is made here of a tubular abutment 14 with ribs 14'. Such an abutment is made of a flexible and resilient material which is snapped over the entire length into the continuous open chamber 11. When the door sheet is in its closed position, as shown in FIGS.1 to 3, the tubular abutment 14 fits into the rounded cavity 3' of the bumper 3.

On the side turned away from the hinge side, different solutions may be applied depending on the fact that the door is a two-way door or a one-way door.

In order to solve this problem without having to change neither the door sheet nor the jambs, use is made of abutments of different types.

In FIG. 1, an abutment 15 of a particular type is snapped into the continuous open chamber 11 of the jamb. This abutment 15 has on both sides resilient lips 15' between which the edge of the door sheet 4 is retained in the closed position of the door.

Figure 19:
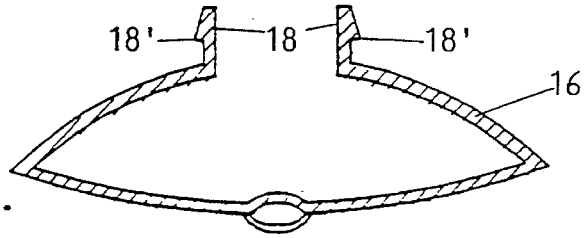
FIG. 19 is a cross-section through a wedge-shaped abutment for a two-way door sheet.
Figure 20:
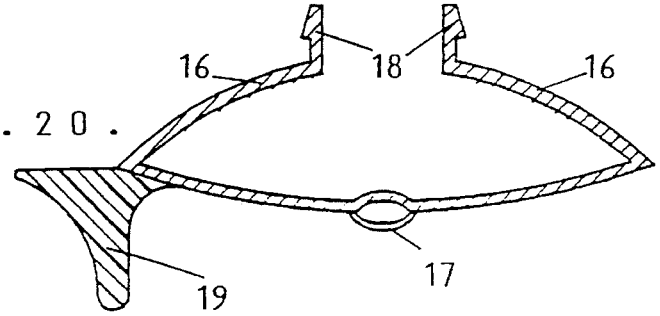
FIG. 20 is a cross-section through a wedge-shaped abutment for a one-way door sheet.

A series of other abutments are shown in FIGS. 19 to 23. The specific abutment according to FIG. 23 can also be seen in FIG. 5. The abutments 16 according to FIGS. 19 and 20 are wedge-shaped abutments which are each provided with a central continuous bulge 17.

All abutments have two continuous wings 18 with hook-shaped projections 18' for fitting them into grooves 12 provided in the inner wall of the continuous open chamber 11.

The wedge-shaped abutment 16 according to FIG. 19 is intended for letting the door panel pass in both directions. The wedge-shaped abutment 16 according to FIG. 20 is provided with a resilient lip 19 for stopping the door sheet so that such a wedge-shaped abutment can only be present on a one-way door.

Figure 21:
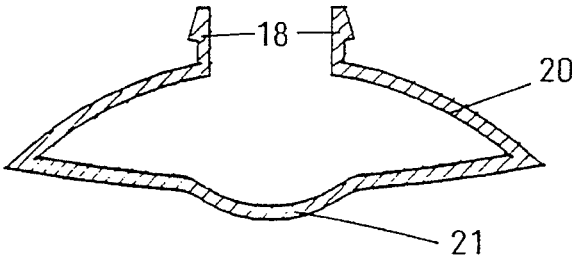
FIG. 21 is a cross-section through a spherical abutment for a two-way door sheet.
Figure 22:
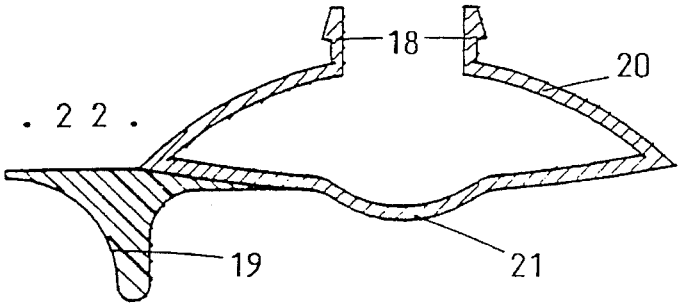
FIG. 22 is a cross-section through a spherical abutment for a one-way door sheet.
Figure 24:
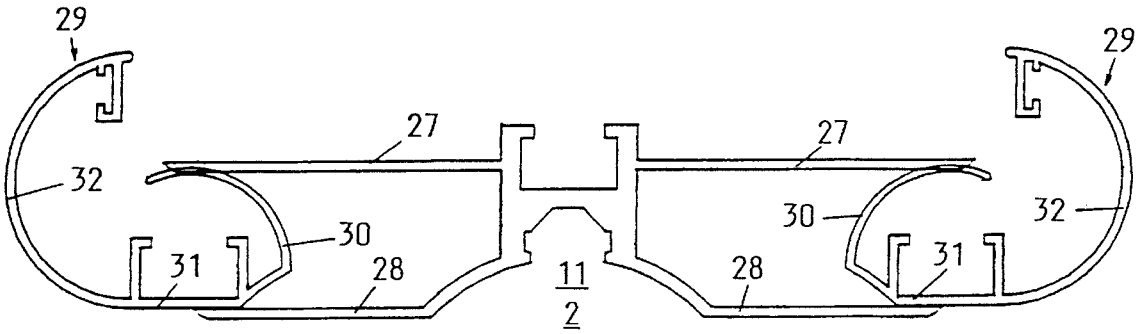
FIG. 24 shows the jamb-linings to be used in combination with a jamb according to the invention.

The abutments 20, according to FIGS. 21 and 22, are spherical abutments since the bulge 17 was here replaced by a continuous rounding 21.

Here the difference can also be seen between the spherical abutment according to FIG. 21, intended for a two-way door, and the abutment according to FIG. 22 which is equipped with a resilient lip 19 of the type which is present in FIG. 20.

Figure 28:
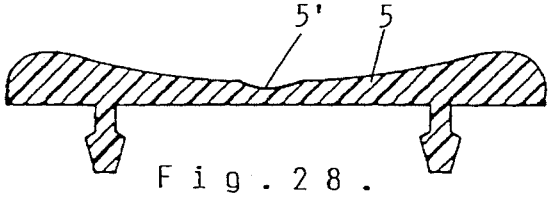
FIG. 28 is a cross-section through a bumper to be used in combination with a wedge-shaped abutment.
Figure 29:
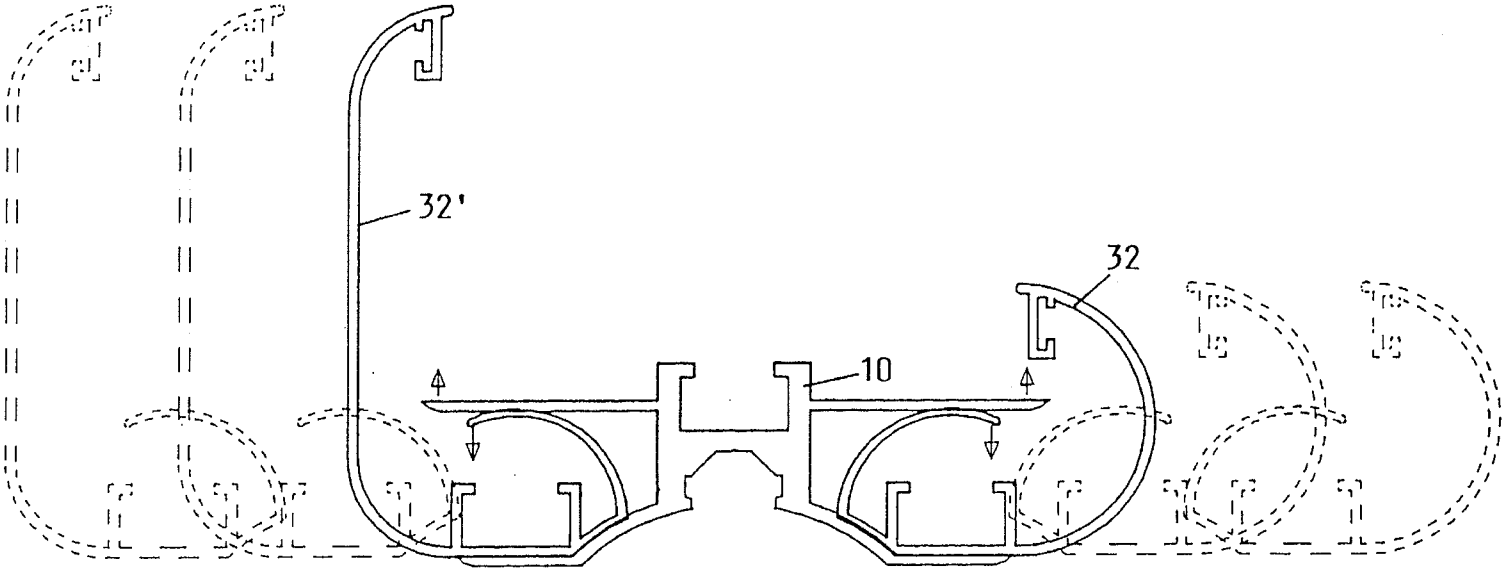
FIG. 29 illustrates the way wherein the jamb-linings can be pressed in a profile forming a jamb.

The just described abutments 16 are designed for cooperating with bumpers of the type according to FIG. 28 (bumper 5).

The abutments 20 are designed for cooperating with bumpers of the type according to FIG. 32 (bumper 6).

It is immediately clear that by making use of abutments according to FIGS. 19 or 21, the possibility is created to turn the door sheet in both directions while with abutments according to FIGS. 20 or 22, the door can only be opened in one direction. It is therefore also immediately clear that by fixing an abutment a resilient lip in a certain direction in the jamb profile, the door sheet can be moved in the first or in the other direction.

Figure 4:
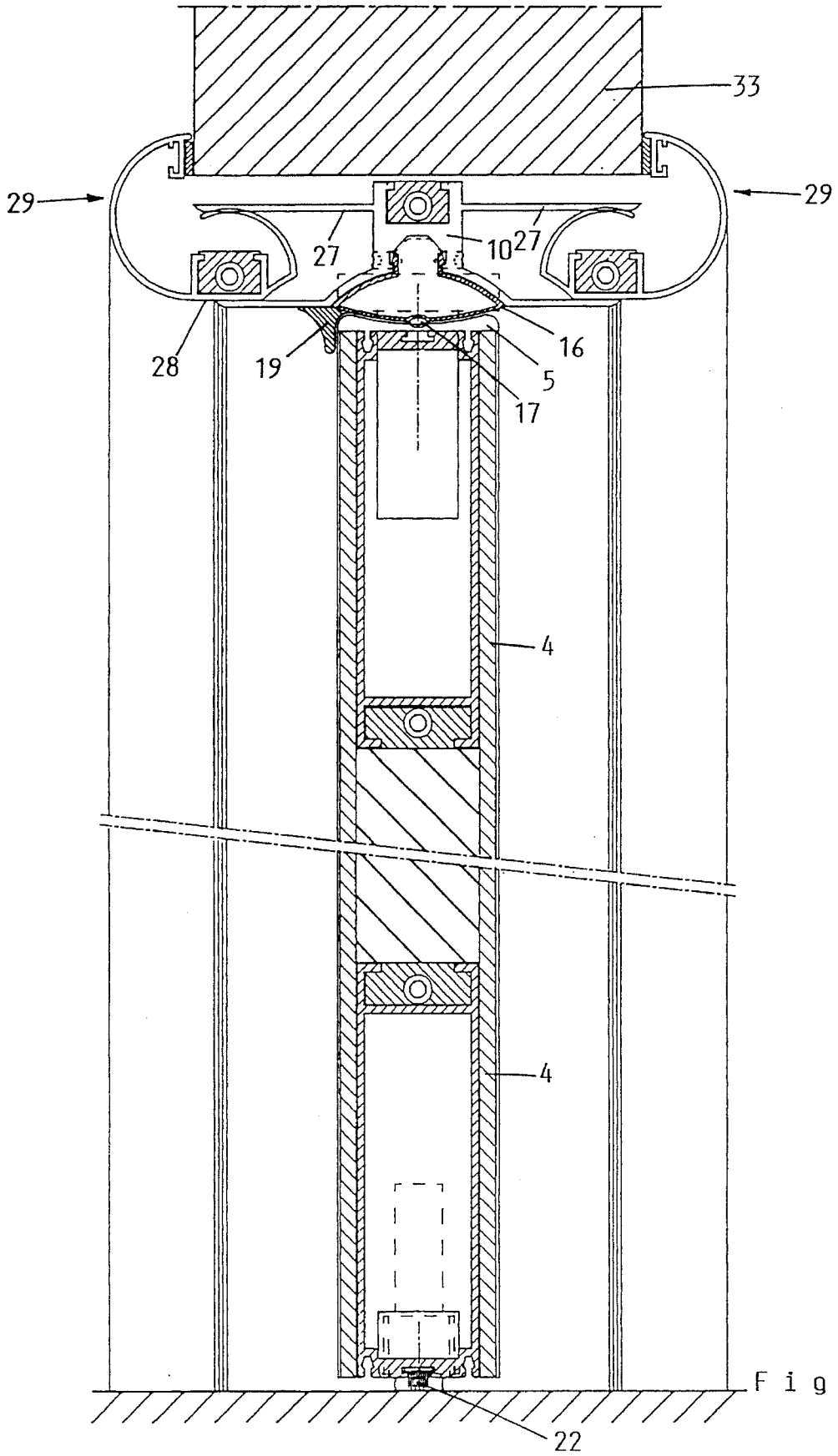
FIG. 4 is a longitudinal section through a one-way door having a wedge-shaped abutment.

FIG. 4 relates to a door wherein the door sheet is equipped on the top with an abutment 16 of the type shown by FIG. 20. Such a door is on the top weather tight whilst small brushes 22 seal it off underneath.

Figure 5:
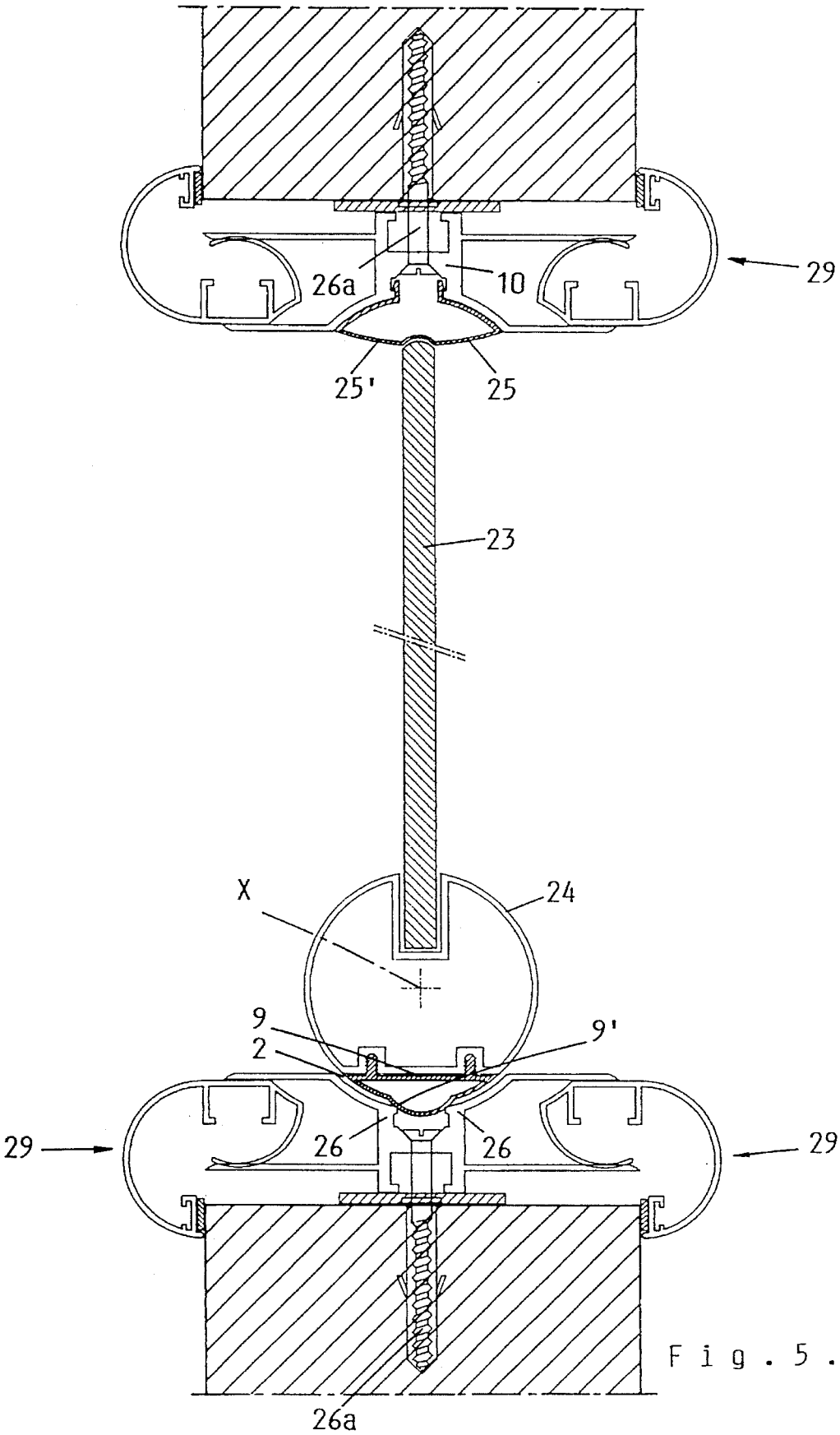
FIG. 5 is a cross-section through a two-way glass door having a wedge-shaped abutment.
Figure 23:
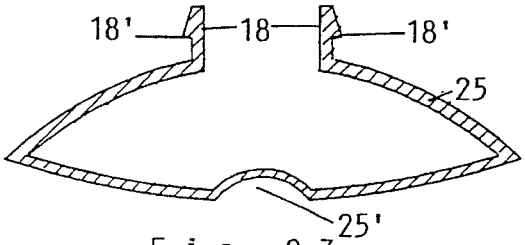
FIG. 23 is a section through an abutment to be used on the side of a glass door sheet or the like turned away from the pivot axis.

A particular type of bumper is shown by FIGS. 5, 10, 11 and 31. As shown in FIG. 5, with a variant embodiment of door sheet being a glass panel 23, this panel is fitted into a tubular profile 24 and this tubular profile 24 is provided with a bumper 9 with spherical bulge 9'. This spherical bulge 9' locks itself, in the closed position of the door, in the continuous open chamber 11 while the opposite edge of the glass door sheet 23 is retained in the continuous arcuated groove 25' of the abutment 25 (FIGS. 5 and 23).

The abutment 25 is of the type to which the wedge-shaped abutments pertain, with this difference that the arcuated groove 25' fulfils here the function of either the bulge 17 or the continuous rounding 21.

In order to avoid wear of the spherical bulge 9', the edges 26 of the continuous open chamber 11 which are directed towards one another can be adapted to the rounding of the spherical bulge 9' of the bumper 9.

Figure 11:
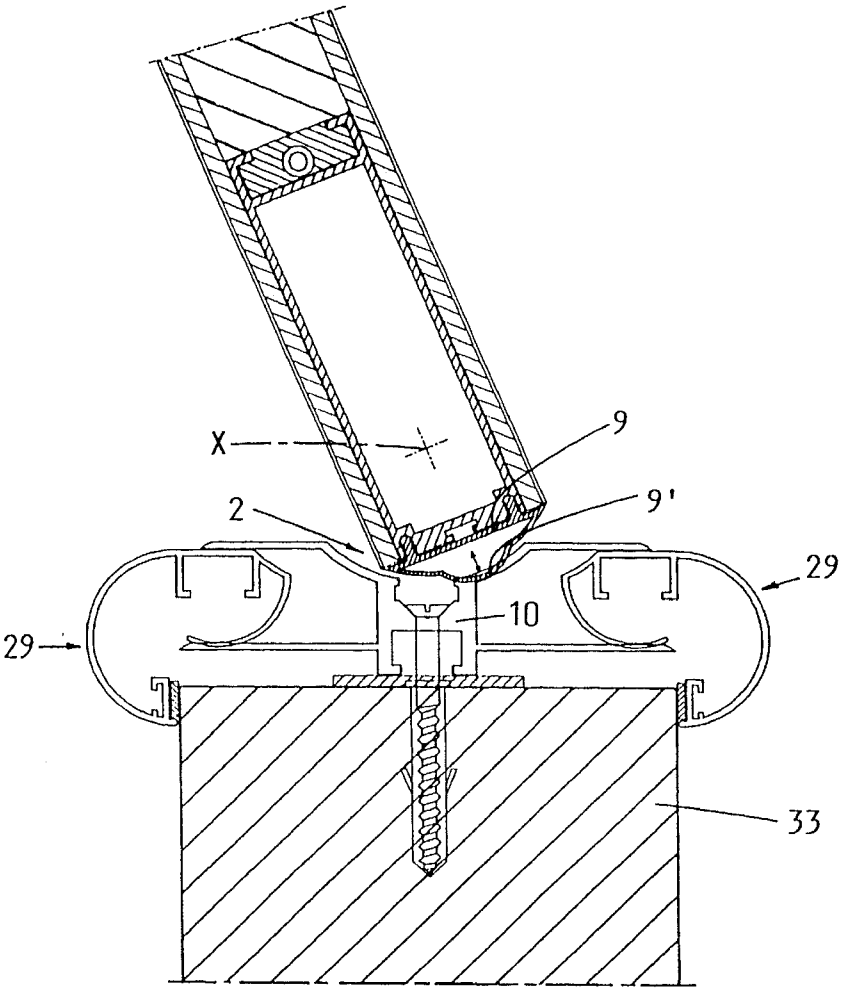
FIG. 11 is a section through a portion of a partially open door sheet with respect to a jamb according to the invention, wherein the door sheet is provided on the hinge side with a bumper according to a variant embodiment.
Figure 10:
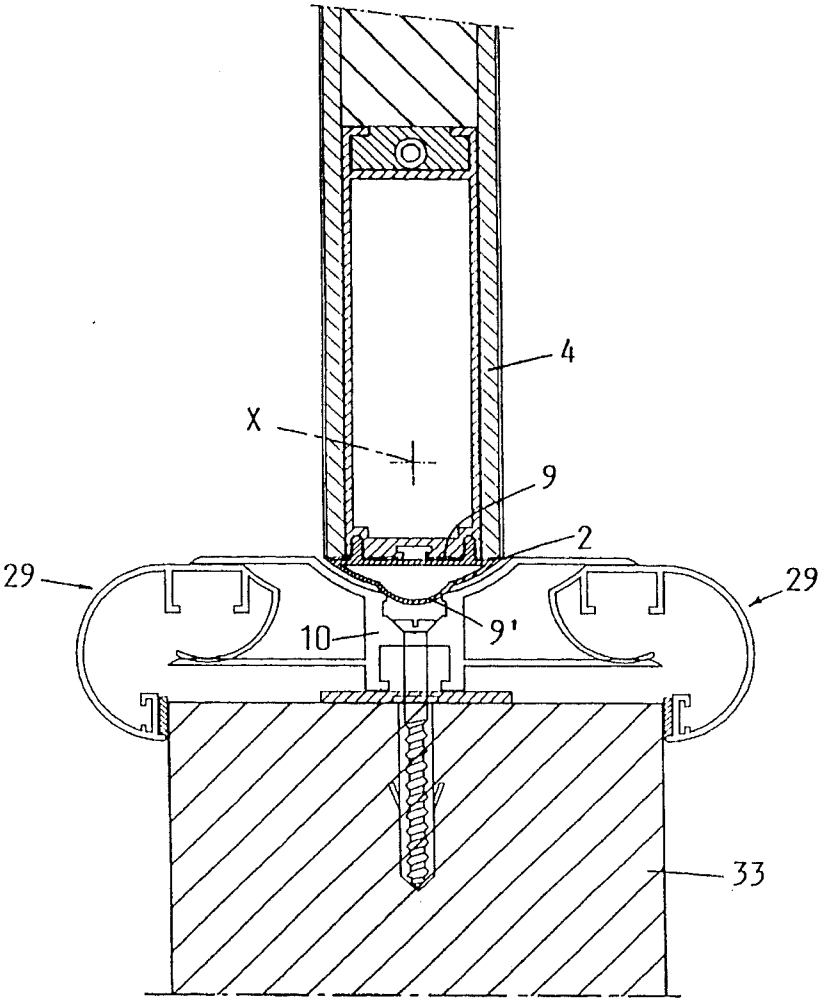
FIG. 10 is a section through a portion of a closed door sheet with respect to a jamb according to the invention, wherein the door sheet is provided on the hinge side of a bumper according to a variant embodiment.
Figure 12:
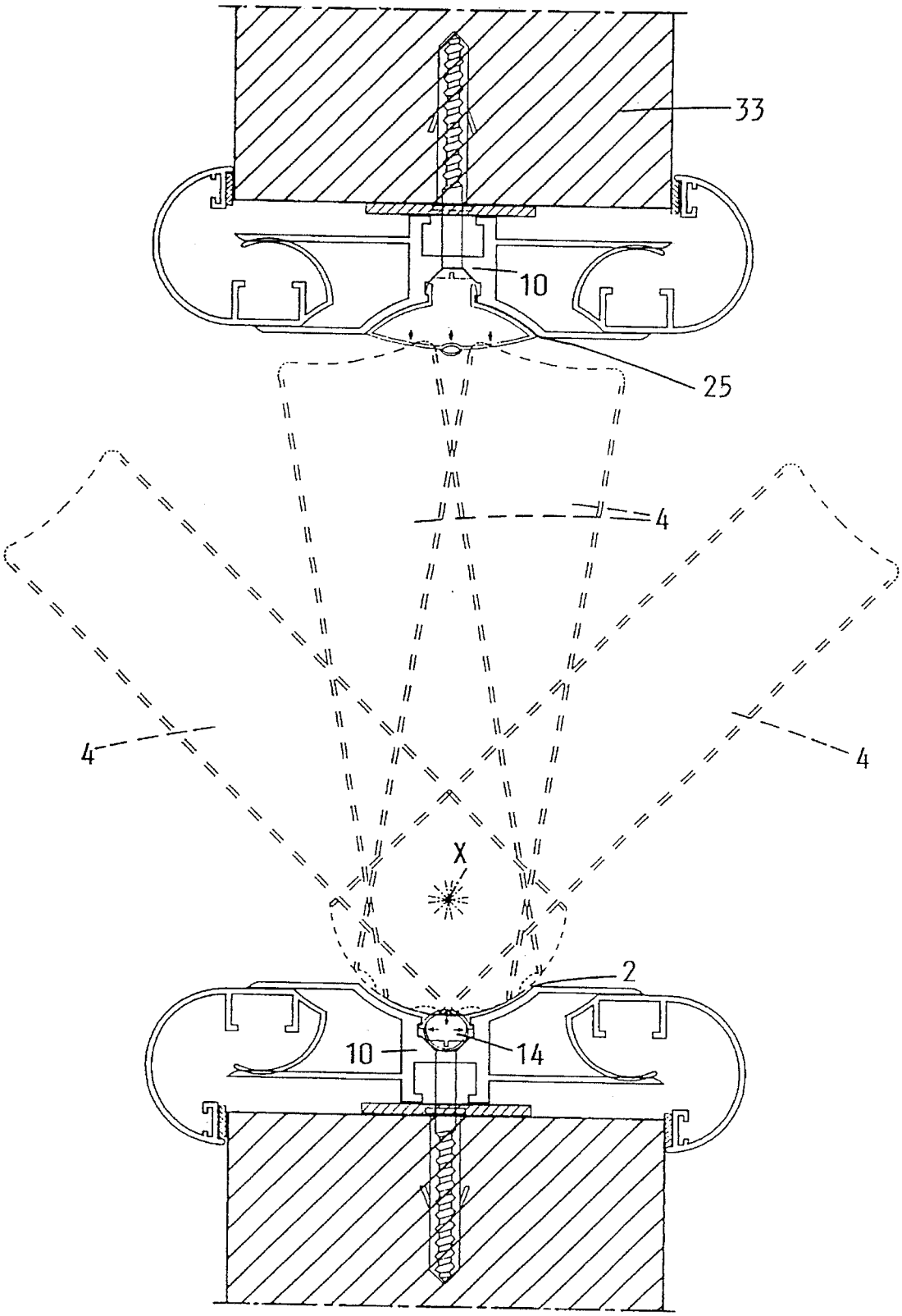
FIG. 12 shows four theoretically possible positions of a door sheet with respect to a jamb having a tubular and wedge-shaped abutment for a two-way configuration.

In FIGS. 10 and 11, it can be seen clearly how the bumper 9, for a closed door, installs itself with its bulge 9' nicely into the continuous open chamber 11, while for a door turned open over an angle, this bulge 9' blocks itself against the wall of the bowl-shaped cavity 2 of the jamb 1.

The deformation of the flexible and deformable bumper 9 is not shown in FIG. 11. The magnitude of this deformation can however be derived from the presence of arrows which indicate this deformation.

It has to be remarked that the bumper 9 with its bulge 9' is the same as the one shown in FIG. 5.

From the here given description of the different abutments and the bumpers cooperating therewith, it can be deduced which function is fulfilled by these components, both as to the weather tightness and as to blocking the door sheet in the closed position.

Figure 6:
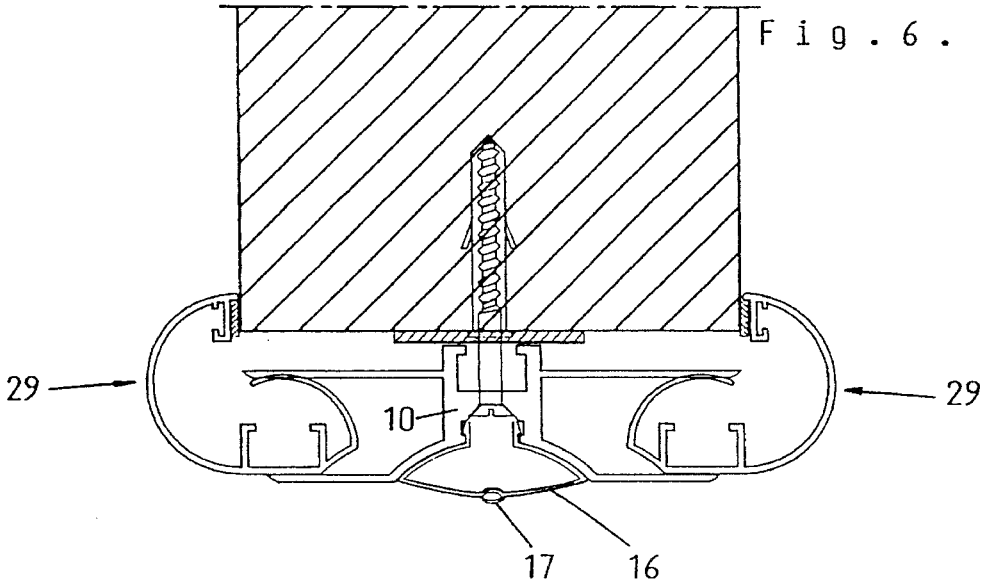
FIG. 6 illustrates the way wherein a wedge-shaped abutment can be pushed into a jamb.
Figure 7:
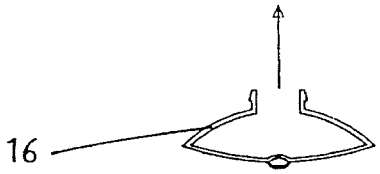
FIG. 7 illustrates how a tubular abutment is fixed into the continuous open chamber of the jamb.
Figure 7:
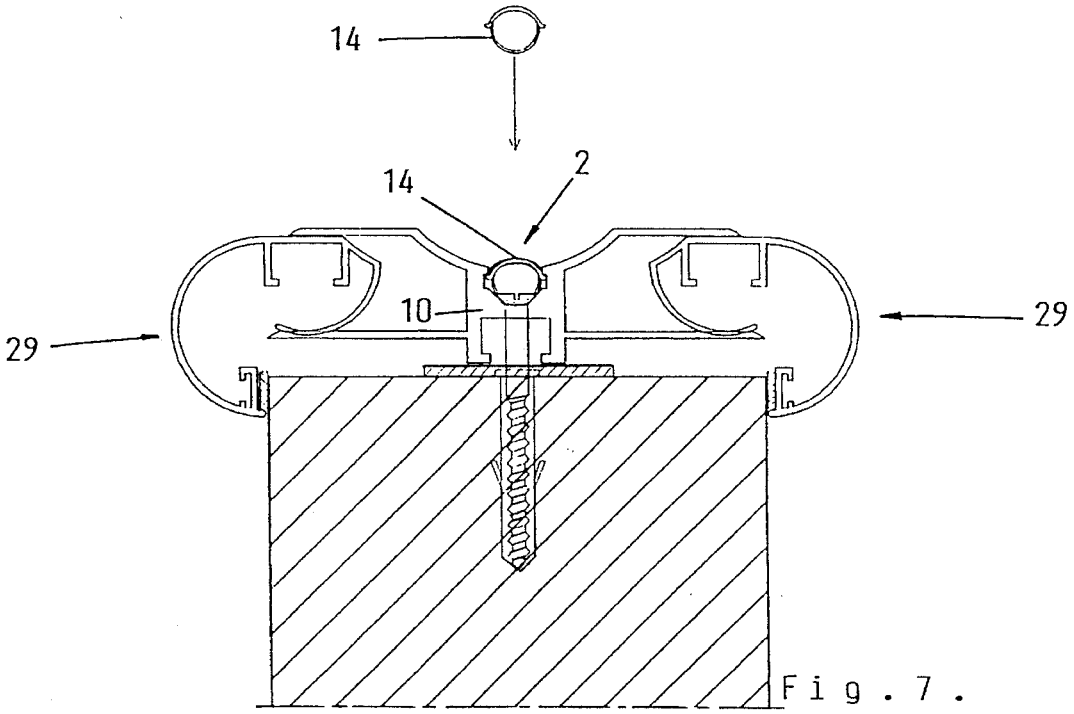

As to these components, reference can further be made to different figures such as FIG. 6 which shows how an abutment is pushed or snapped into a jamb. FIG. 7 shows, on the contrary, how the tubular abutment 14 is fixed into the continuous open chamber 11 of the jamb.

Figure 8:
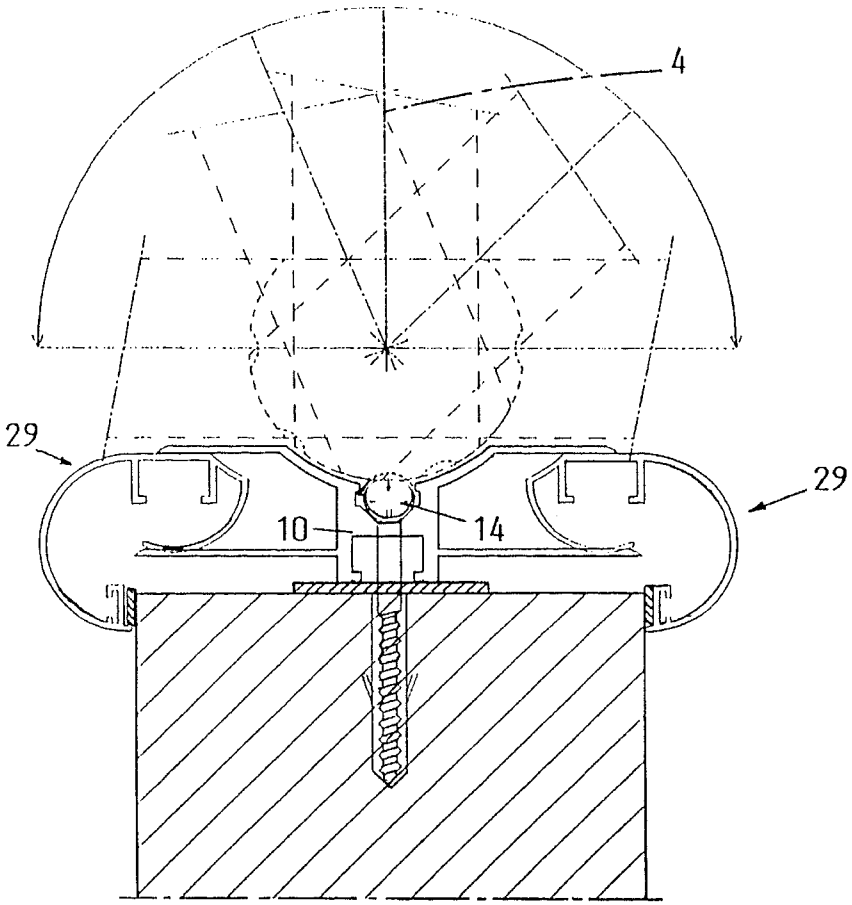
FIG. 8 shows five possible positions of a door sheet with respect to a tubular abutment and a jamb according to the invention.

FIG. 8 illustrates schematically the positions wherein a door sheet which can be turned over 180° can be pivoted with respect to a jamb.

Figure 9:
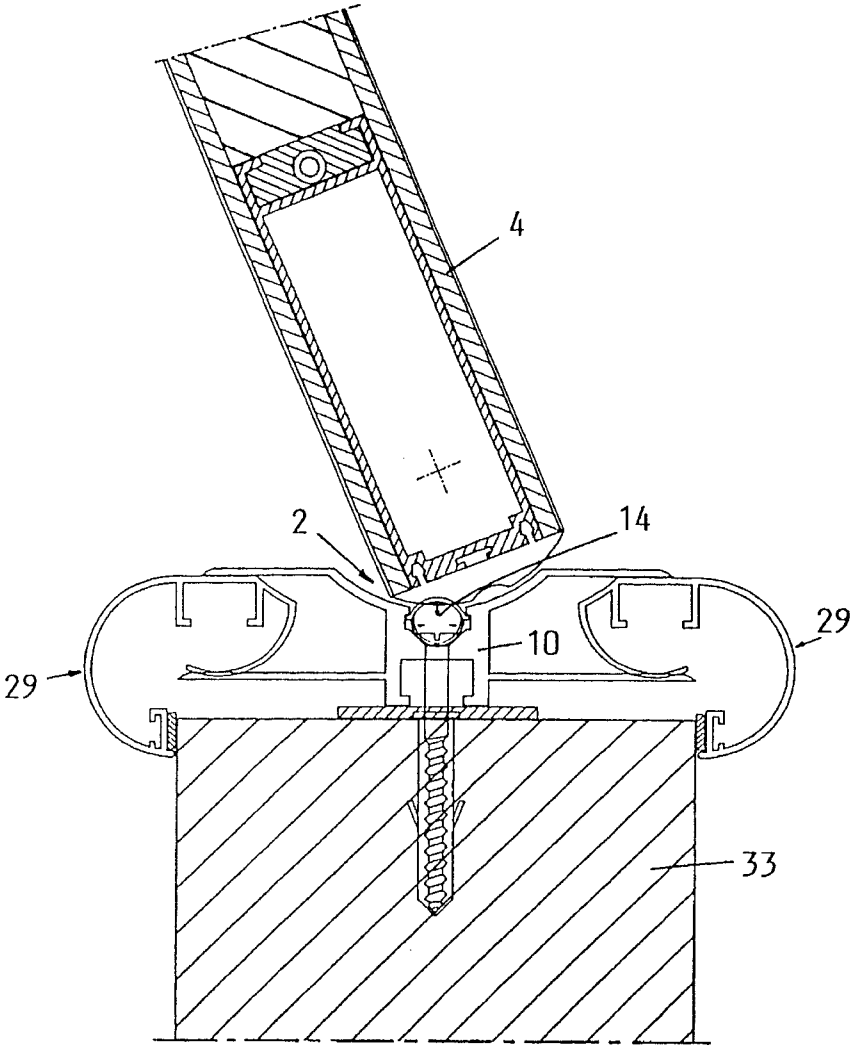
FIG. 9 is a section through a portion of a partially open door sheet with respect to a tubular abutment in a jamb according to the invention.

FIG. 9 shows how a tubular abutment 14 can be deformed in two directions when a bumper 3 is displaced along such an abutment.

Figure 13:
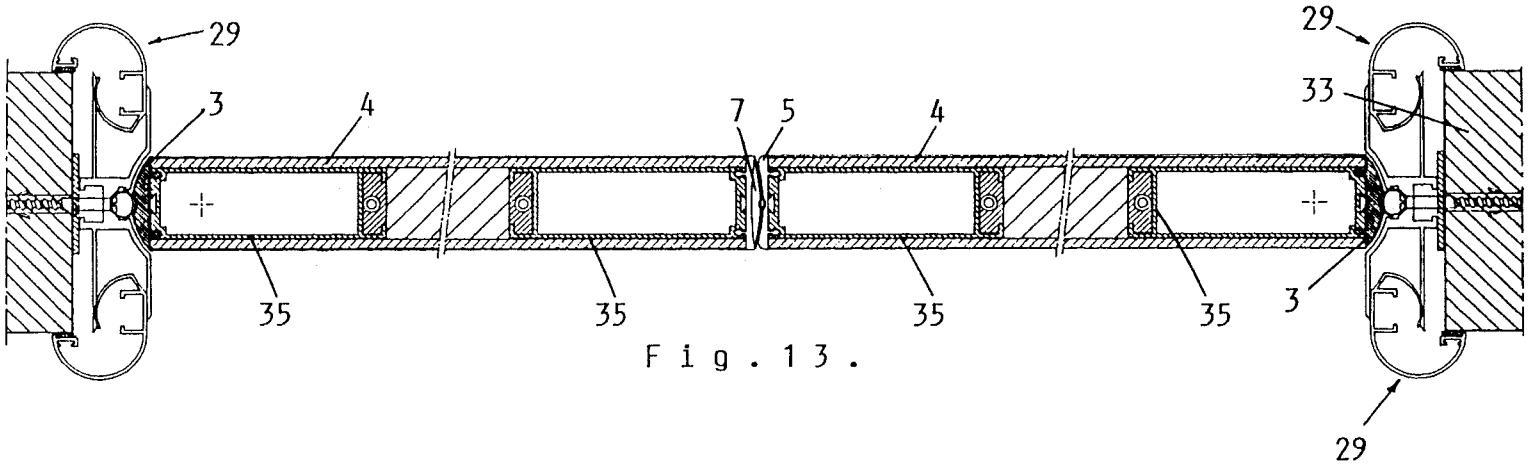
FIG. 13 shows, on another scale, a door equipped with two door sheets according to the invention.
Figure 15:
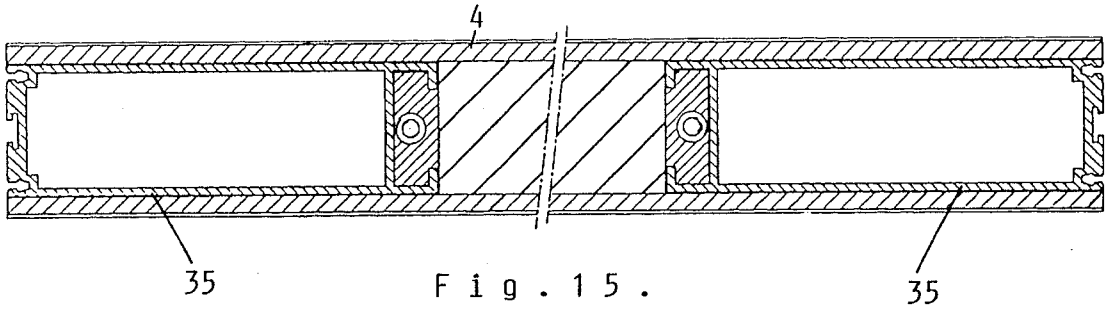
FIG. 15 is both a cross-section and a longitudinal section through components forming the door sheet according to the invention.

When two door sheets are made to cooperate with one another so as to form a so-called double door, it is sufficient to provide the edges of the door sheets which are directed towards one another with cooperating abutments and bumpers as can be seen in FIG. 13.

In several figures, for example in FIGS. 1, 2, 5 and 18, it can be noticed clearly that the cross-section of the continuous open chamber 11 fulfils several functions. The walls (a) of the continuous open chamber 11 are directed for example under such an angle that the head of a screw 26*a*, which goes through the body of the jamb profile, is precisely adjusted to the slope of the sides.

The jambs extending around the perimetry (at least along three sides) show further two parallel wings 27 and 28 between which jamb-linings 29 can be clamped. These jamb-linings are formed of aluminium profiles with a curved resilient wing 30 thanks to which the jamb-lining itself is stuck between the wings 27 and 28 of the jamb. Further, the jamb-lining has substantially opposite the resilient wing 30, a flat strip 31 for maintaining it under pressure against the inner side of wing 28. The semi-circular strips 32 of the jamb-lining profiles close off on both sides of the jamb the space between the wing 28 and the wall 33. A sealing strip seals this space hermetically.

The here described jamb-linings 29 are those which can be seen in different figures.

Figure 25:
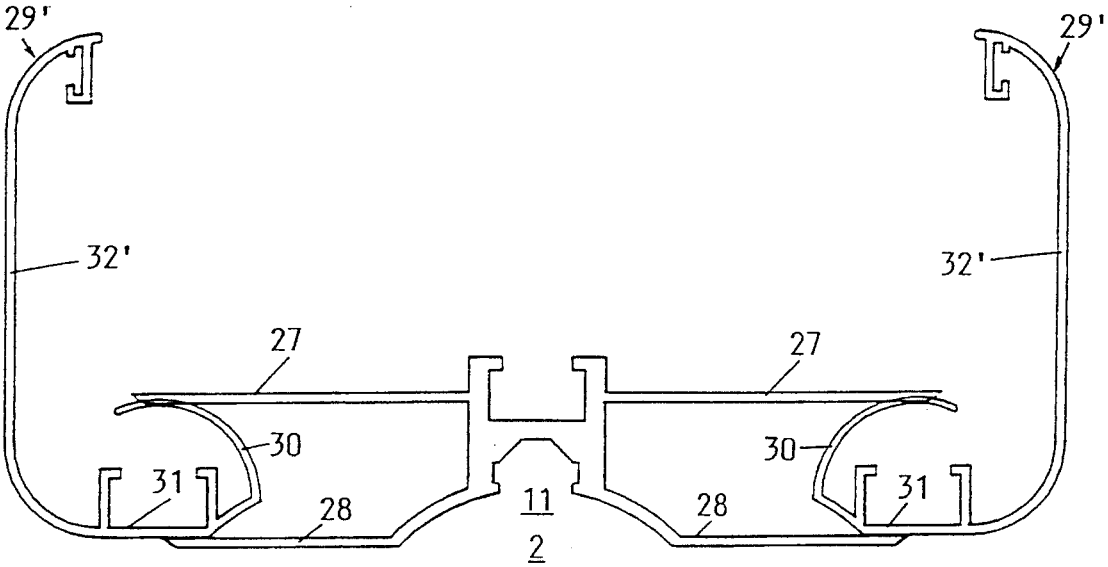
FIG. 25 shows a variant embodiment of the jamb-linings according to FIG. 24.
Figure 26:
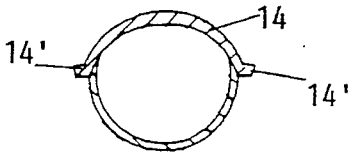
FIG. 26 is a cross-section through a tubular abutment in a jamb according to the invention.

FIG. 25, however, relates to a variant embodiment wherein the jamb-lining 29' has a rectilinear strip 32' which fulfils the same function as the semi-circular strips 32. It is clear that several other profiles may be appropriate for forming the jamb-linings.

It is immediately clear that jamb-linings according to the here described examples can be adapted to all kinds of wall thicknesses and to compensate for the tolerances related thereto.

The invention also relates to the structure of the door sheet itself. This original structure was not only invented for counteracting any deformability of the door sheet. Due to the original concept of the door itself with its two vertical edges and the upper horizontal edge, provided with bumpers, the door sheet has to cooperate purely with the different abutments described earlier in this application.

Figure 34:
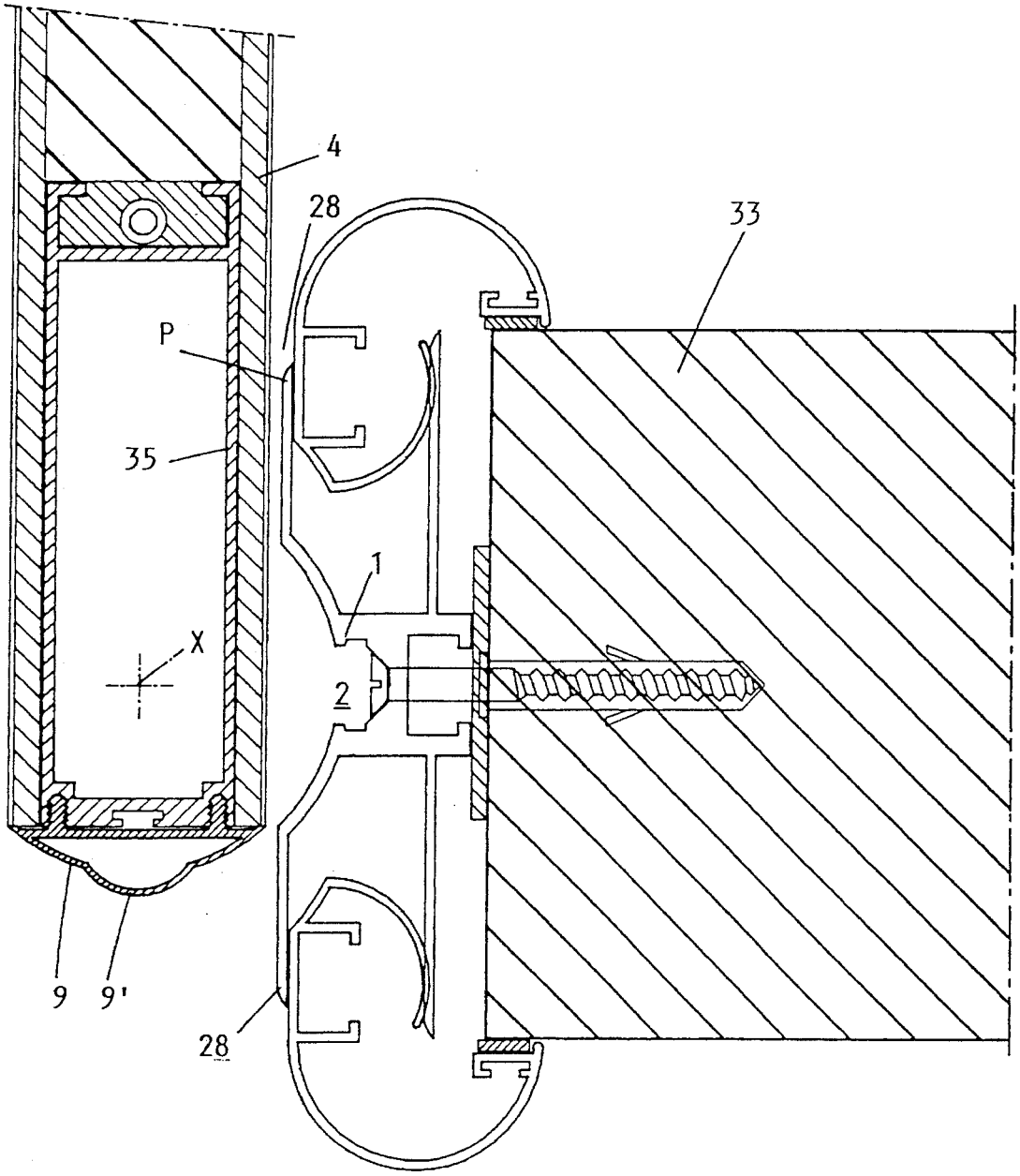
FIG. 34 illustrates the problem which could be caused by a lever moment on the pivot axis of the door.

The door sheet has further to show such a strong inner structure that the pivot of the hinge itself offers resistance when in the open door an important lever moment is generated which can occur when a pressure is exerted onto the door sheet and the door sheet pushes in the zone to which point P (FIG. 34) belongs against the wing 28 of the jamb 1. The lever moment which acts upon the hinge and door sheet structure is considerable in view of the position of the pivot axis X with respect to said point P.

Figure 33:
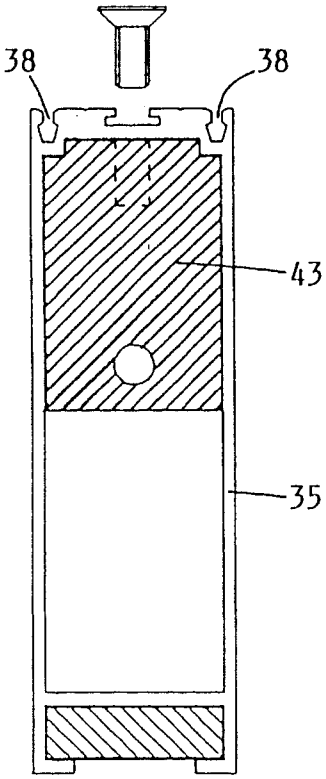
FIG. 33 shows a section through the aluminium framework used for reinforcing the door sheet.
Figure 16:
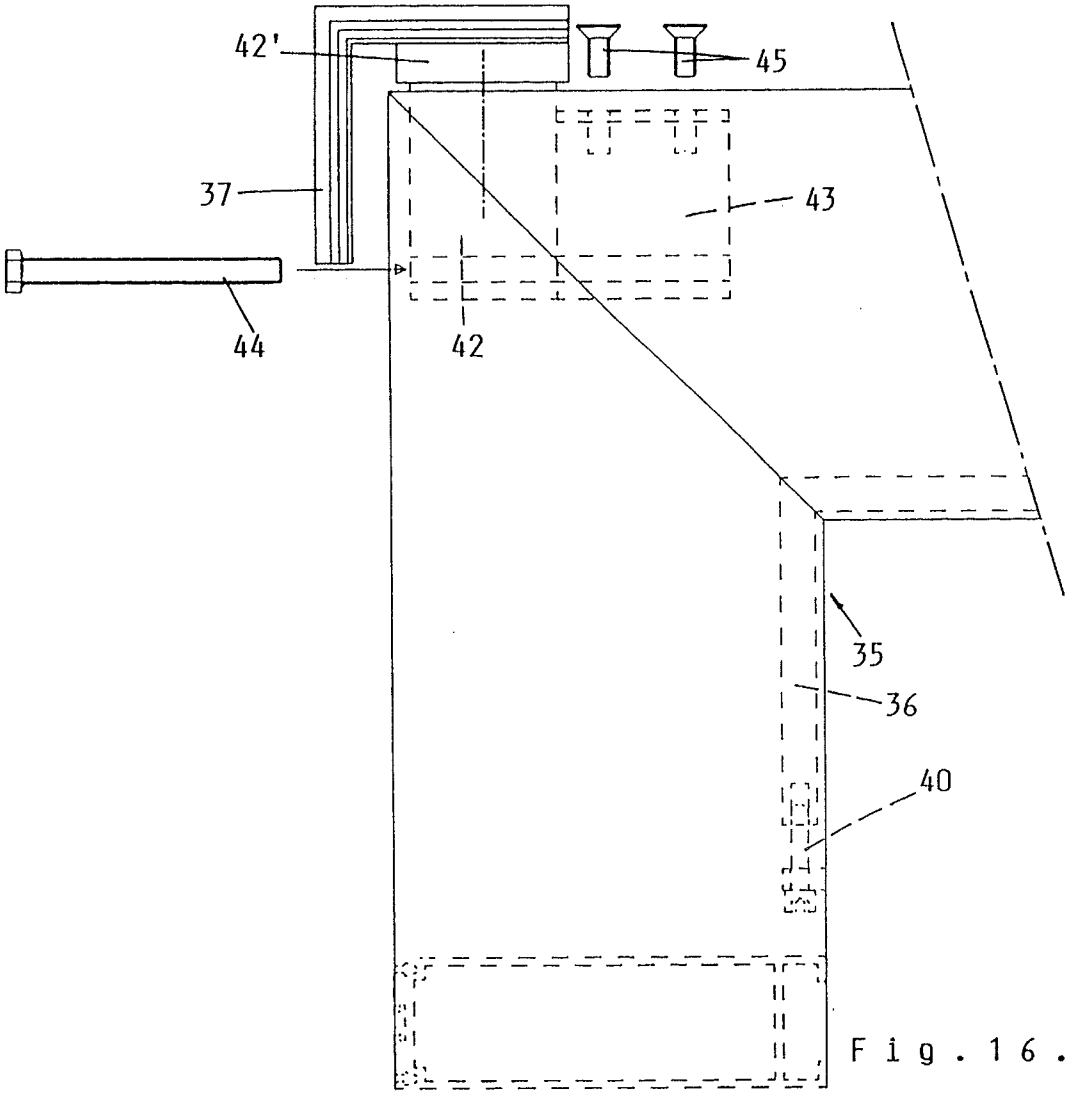
FIG. 16 shows, on an enlarged scale, a corner connection and an upper hinge fitting of a door sheet according to the invention.

To obviate this, the door sheet is equipped internally with an aluminium framework formed of hollow profiles 35 which can be seen in FIGS. 16 and 33. In the corners, the connection between transverse and longitudinal profiles is achieved by making use, along the inner edge, of a connection corner 36. The section of the aluminium profiles 35 is shown clearly in FIG. 33. It is a strong hollow profile with recesses 38 wherein the taps provided on the bumpers can be snapped.

Figure 14:
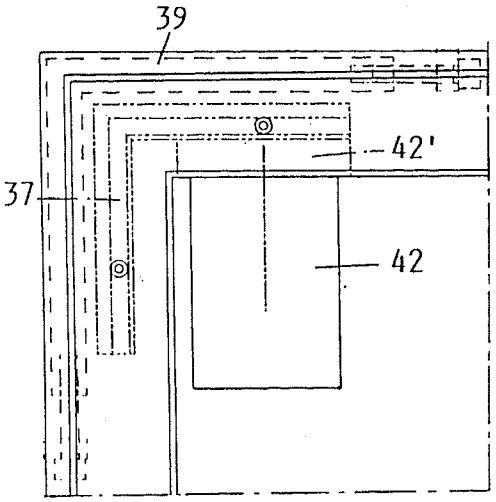
FIG. 14 shows, on still another scale, a corner connection and a hinge mounting in a jamb according to the invention.

Referring to FIG. 14, it can first of all be seen how jambs 1 are mutually connected by connecting pieces 39 by screwing tighter pulling bolts 40.

Figure 17:
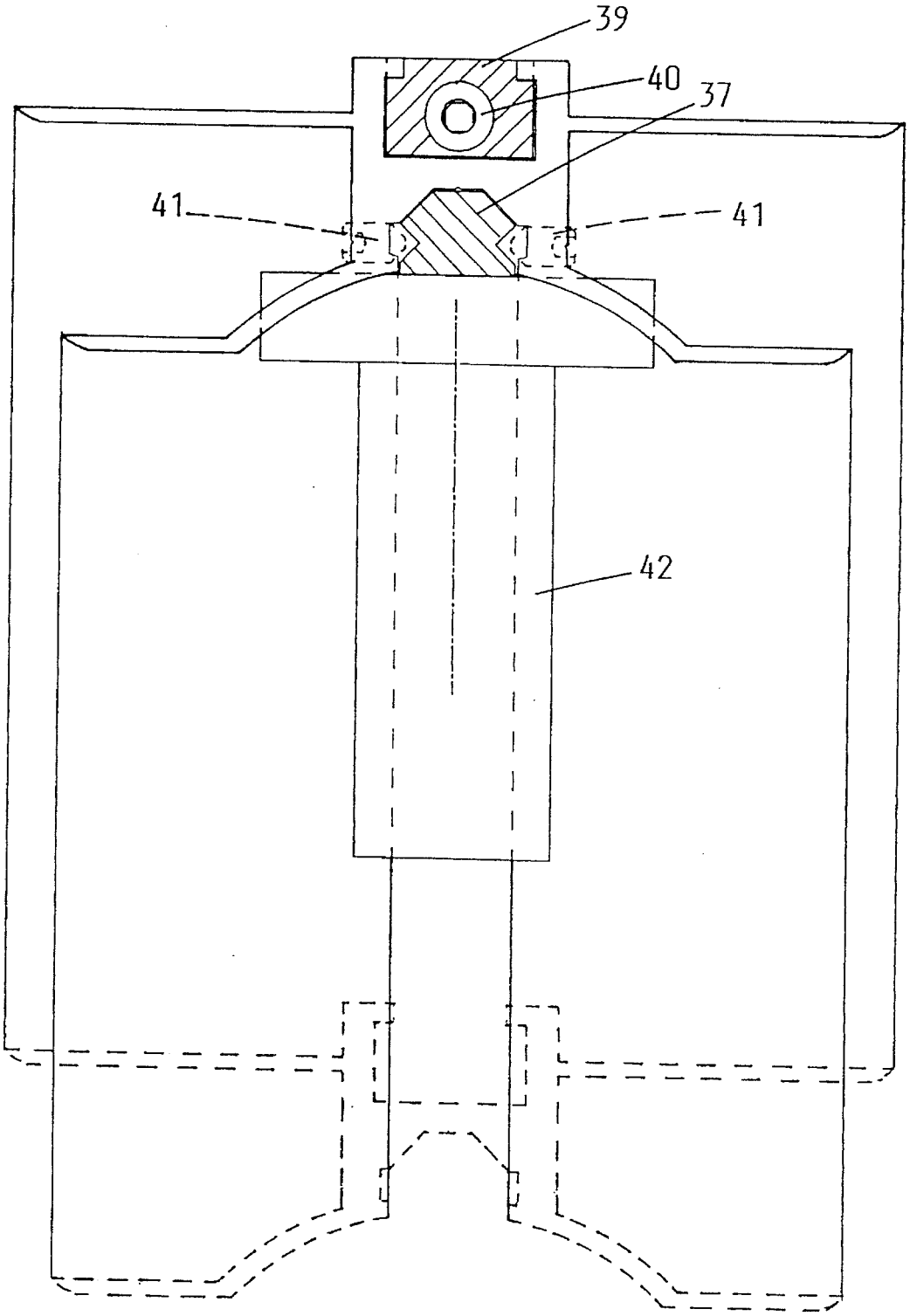
FIG. 17 shows details related to the assembly of a pivot axis in a jamb according to the invention.

The angle bar connection profile 37 of the upper hinge is pushed in the corner connection between two jambs (FIG. 14). This angle bar can be seen in section in FIG. 17. The cross-section of this angle bar corresponds partially to the cross-section of the continuous open chamber 11 of the jamb and is therefore clamped herein by means of small socket head screws 41.

The rectangular component 42 is also a part of the angle bar 37. Against this component caught in the aluminium profile 35, there is screwed an attachment block 43 for the pivot of the door by making use of the connection bolt 44 which goes through both components 42 and 43. The component 43 is attached, on the top, to the aluminium profile 35 by means of screws 45. The pivot of the hinge is mounted in the component 42. The portion 42' of the component 42 comprises the means known per se for making the door sheet return to its zero position and the means for allowing the door sheet to be maintained both in the entirely open position and in all intermediate positions.

The door sheet 4 is thus hung up in chamber 11 of the jamb 1 by means of the angle bar attachment pieces 37 provided on the pivoting upper and lower hinges which are fixed in their turn by means of attachment blocks 43 in the upper and lower corner of the door sheet.

From the hereabove given description of the door, the door sheet and the jambs and jamb-linings pertaining thereto according to the invention, the following clear advantages of these structures become apparent:

a) the mutual interchangeability of the various door abutments which allows a change from a one-way door to a two-way door and vice versa;

b) the possibility of changing the hinge side of the door;

c) the fact that no latch has to be installed since the abutment construction makes this redundant;

d) the construction of the reinforced door sheet and the concept of the tubular profile for glass doors which houses the hinge, whereby the moment in case of overloading as a result of the lever effect is compensated for;

e) the safety offered by the bowl-shaped profile of the jambs whereby the dangerous nut-cracker effect is avoided especially when considering the fingers of children.

It is clear that the invention is not limited to the hereabove described embodiment and that modifications can be applied thereto in as far as they fall within the scope of the claims annexed hereto.

What is claimed is:

1. A door comprising a door sheet and jambs and jamblinings which are to be fitted into a wall opening, a first jamb being fitted vertically against one side of the wall opening, the door sheet having a pivot axis positioned a predetermined distance from the first jamb, at least the first jamb having a continuous bowl-shaped cavity facing the door sheet, a corresponding edge of the door sheet fitting into the continuous bowl-shaped cavity, the bowl-shaped cavity having a radius substantially equal to a distance between a center line of the pivot axis of the door sheet and the edge of the door sheet and having a continuous open chamber, the continuous open chamber having a cross-section for receiving different abutments and bumpers and the continuous open chamber having lateral continuous grooves.

2. The door as claimed in claim 1, wherein the edge of the door sheet is provided with a bumper which cooperates with an abutment fitted in said bowl-shaped cavity of said jamb and which has a radius substantially equal to the distance between the center line of the pivot axis of the door sheet and the edge of the door sheet.

3. The door as claimed in claim 2, wherein the abutment is a tubular abutment having a continuous rib on each side thereof, the ribs fitting into the lateral continuous grooves of the continuous open chamber.

4. The door as claimed in claim 1, wherein second and third jambs are provided in addition to the first jamb and wherein each of the jambs have a bowl-shaped cavity, the second jamb being on an upper side of the wall opening and the third jamb being on a side of the wall opening opposed to the side having the first jamb, the door sheet having a bumper on an upper side thereof an on at least one of the lateral sides thereof, abutments being provided in the bowl-shaped cavities of the jambs for cooperating with the bumpers fixed on the door sheet.

5. The door as claimed in claim 4, wherein at least one of the abutments is wedge-shaped with two curved sides, one of the curved sides of the abutment having one of a rounding and continuous bulge.

6. The door as claimed in claim 4, wherein at least one of the abutments is spherically shaped with two curved sides, one of the curved sides of the abutment having one of a rounding and continuous bulge.

7. The door as claimed in claim 4, wherein said abutment has two continuous flexible wings, said edge of the door sheet being caught between the wings in a rest position.

8. The door as claimed in claim 4, wherein the bumpers on the door sheet are received in the bowl-shaped cavities of the second and third jambs and have a rounded cavity formed therein.

9. The door as claimed in claim 4, wherein the abutments have a continuous lip on one side thereof for retaining the door sheet.

10. The door as claimed in claim 1, wherein the jambs comprise laterally extending wings for receiving the jamblinings.

11. The door as claimed in claim 10, wherein said jamblinings comprise a resilient wing clampable between the wings of the jamb.

12. The door as claimed in claim 1, wherein said jambs include a lengthwise open chamber for receiving at least one hook-shaped connecting piece, the at least one connecting piece being securable in the lengthwise open chamber.

13. The door as claimed in claim 1, wherein jambs are provided along an upper side of the wall opening and along both vertical sides thereof, all of the jambs being the same.

14. The door as claimed in claim 1, wherein a bulge on a bumper of the door sheet is receivable between edges of the continuous open chamber for holding the door sheet in a closed position.

15. The door as claimed in claim 1, wherein the door sheet is reinforced by an internally mounted framework having a hollow profile.

16. The door as claimed in claim 15, wherein the internally mounted framework is aluminum and wherein an attachment block is provided in the framework, the attachment block having a component rigidly connected thereto, the attachment block being secured in two hollow profiles which form the framework, the component receiving the pivot axis of the door.

17. A door comprising a door sheet and jambs which are to be fitted into a wall opening, the jamb being fitted vertically against one side of the wall opening, the door sheet having a pivot axis positioned a predetermined distance from the jamb, a continuous bowl-shaped cavity being provided in the jamb, the bowl-shaped cavity facing the door sheet and having a radius substantially equal to a distance between a center line of the pivot axis of the door sheet and an edge of the door sheet, a bumper being mounted on the edge of the door sheet and being received in the bowl-shaped cavity, the door sheet having a front side and a rear side, a first plane passing along and generally parallel to the front side of the door sheet and a second plane passing along and generally parallel to the rear side of the door sheet, the bumper being contained between the first and second planes.

18. The door as claimed in claim 17, wherein a plurality of jambs are provided around the wall opening and wherein at least the jamb fitted vertically against the one side of the wall opening has a continuous open chamber therein, the continuous open chamber having a cross-section for receiving different abutments and bumpers.

19. The door as claimed in claim 17, wherein the bumper has a bulge thereon, the bulge being positionable within the bowl-shaped cavity.

20. The door as claimed in claim 17, further comprising an abutment provided on one of the bumper and within the bowl-shaped cavity in the jamb.

* * * * *